US008940360B1

(12) United States Patent
Brasier et al.

(10) Patent No.: US 8,940,360 B1
(45) Date of Patent: Jan. 27, 2015

(54) ROAD SURFACE REPAIR COMPOSITIONS, PROCESSES AND APPLICATOR APPARATUSES

(75) Inventors: Melvin D. Brasier, Montrose, CO (US); Thomas W. Seaberg, Severance, CO (US)

(73) Assignee: MeadWestvaco Corporation, Richmond, VA (US)

( * ) Notice: Subject to any disclaimer, the term of this patent is extended or adjusted under 35 U.S.C. 154(b) by 489 days.

(21) Appl. No.: 13/031,898

(22) Filed: Feb. 22, 2011

Related U.S. Application Data

(60) Provisional application No. 61/338,506, filed on Feb. 19, 2010.

(51) Int. Cl.
*E01C 5/12* (2006.01)

(52) U.S. Cl.
USPC ..... 427/138; 427/136; 427/140

(58) Field of Classification Search
CPC ..... E01C 7/085; E01C 7/182
USPC ..... 427/140
See application file for complete search history.

(56) References Cited

U.S. PATENT DOCUMENTS

2006/0088379 A1* 4/2006 Lazic ..... 404/75
2006/0219135 A1* 10/2006 Thorstensson et al. ..... 106/277

OTHER PUBLICATIONS

"Asphalt definition from Wikipedia Feb. 11, 2011", Published in: US.
"Asphalt Emulsion printout from the Internet Oct. 2006", Publisher: Texas Department of Transportation, Published in: US.
"Understanding Emulsion Products", Publisher: Valley Slurry Seal Co., Published in: US, Printout from the internet Feb. 11, 2011.
"Asphalt Seal Coating Direct printout from the Internet Feb. 11, 2011", Published in: US.
"The Chemistry of Asphalt Emulsions, printout from Internet Feb. 11, 2011", Published in: US.
"Engine Mechanics printout from Internet on Feb. 17, 2011", Published in: US.
"Pugmill Systems, Inc. printout from Internet on Feb. 17, 2011", Published in: US.
"Pugmill definition from Wikipedia Feb. 17, 2011", Published in: US.
"Asphalt Emulsion Technology", Aug. 2006, Publisher: Transportation Research Board, Published in: US.

* cited by examiner

*Primary Examiner* — Dah-Wei D Yuan
*Assistant Examiner* — Nga Leung V Law
(74) *Attorney, Agent, or Firm* — MWV Intellectual Property Group

(57) ABSTRACT

An asphalt composition, process, and apparatus for repairing cracks and other distressed areas in road surfaces. The asphalt composition comprises an aggregate material and a cold pour asphalt emulsion, preferably a quickset cationic asphalt emulsion. The aggregate material will preferably be a graded aggregate material. The asphalt emulsion and the aggregate material will preferably be mixed together and then delivered into the distressed area in not more than 20 seconds. A small mixing assembly is preferably held in suspension over the road surface for continuously receiving and mixing the asphalt emulsion and aggregate components and delivering the mixture into the distress area.

17 Claims, 6 Drawing Sheets

ROAD SURFACE REPAIR COMPOSITIONS, PROCESSES AND APPLICATOR APPARATUSES

RELATED CASE

This application claims the benefit of U.S. Provisional Patent Application Ser. No. 61/338,506, filed on Feb. 19, 2010, and incorporates said provisional Application Ser. No. 61/338,506 by reference into this document as if fully set out at this point.

FIELD OF THE INVENTION

This invention relates, in general, to materials, processes and devices for repairing road surfaces.

BACKGROUND OF THE INVENTION

Over time, road surfaces develop cracks due to wear, traffic, environmental conditions and other causes. If the cracks are left untreated, the cracks can develop into larger cracks or potholes, which become more expensive and time-consuming to repair. Moreover, potholes create unpleasant driving surfaces, and in some cases can be hazardous.

Conventionally, cracks are treated and filled with a hot or cold pour sealing agent, usually a hot sealing agent, applied to fill the crack. Typically, in order to create a hot, pourable sealing agent, a large portable reservoir or kettle is maintained at a high temperature, for example 350-425 degrees, in order to raise and maintain the temperature of the sealing agent at a sufficient level. Maintaining the high temperature of the portable reservoir requires the consumption of energy, and when one or more road crews are repairing cracks in roads throughout a town or city for full day shifts, the energy consumption required to maintain the sealing agent at temperature can be significant.

Moreover, a typical conventional hot pourable sealing agent can require hours in order to properly cure, dry and seal the crack in a road. During this time, traffic must be rerouted so as to prevent cars, trucks and other traffic from traveling over the repaired portion of the road, while it cures and dries.

The primary technique traditionally used heretofore for repairing cracks and other distressed pavement areas has been to fill the distressed areas with hot asphalt. In addition to the shortcomings already listed above, other problems associated with hot pour asphalt fillers include: the emission of volatile organic compounds; a lack of adhesion to the sidewalls of the crack or other distressed area; inadequate structural integrity and load-bearing capability; short service life; a lack of skid resistance; lengthy curing times; discoloration; and tracking and adhesive loss on the pavement.

The hot pour asphalt compositions used heretofore for filling cracks and other distressed pavement areas have included some fillers and polymers which have improved the properties of the composition to some extent. However, it does not appear that hot pour asphalt compositions containing aggregates or other such additives capable of providing significant structural support and load-bearing capacity have been successfully formulated and used for filling pavement cracks. The hot asphalt composition has simply been placed in cartons, cooled, and then reheated at the pavement site for pouring into the pavement cracks.

As mentioned above, as an alternative to hot asphalt filling, another technique used for repairing cracks in pavement has been to fill the cracks with a cold pour asphalt emulsion. However, in addition to having all of the same problems and shortcomings as listed above for hot pour asphalt, the existing cold-pour compositions and techniques are particularly noted for bad quality and a lack of bonding to the existing pavement. The cold pour emulsion materials used heretofore have been much too soft and, as with the hot pour materials, have lacked any aggregate framework to provide load-bearing strength. Moreover, as compared to hot asphalt, any effort to add aggregate materials to cold pour asphalt emulsions prior to use for road repair would be particularly problematic because the contact between the aggregate material and the asphalt emulsion causes the emulsion to break and begin to set.

As is known in the art, cold pour asphalt emulsion compositions are generally classified as anionic or cationic and can be slow, medium, or fast setting. Although anionic cold-pour asphalt emulsions have been used for filling pavement cracks with less than desirable results, it is not believed that cationic compositions have not been adequately developed for crack repair or pothole applications. The anionic emulsions are much more stable and have heretofore been understood to create more usable mixtures.

During road paving operations, in order to provide structural support for asphalt road materials, large pugmill paving mixers are used for blending aggregate fillers with the hot asphalt or with cationic quick-set asphalt emulsions prior to laying a broad swath of the material to form a road layer. Hot mix asphalt paving requires, among other things, that (a) liquid asphalt and aggregate be mixed at high temperature in a hot mix asphalt plant and then (b) the hot mixture be carried to the paving site by a series of dump trucks and the pavement layer be formed using a placement device (or screed) and various compaction rollers. The machines used for cold pour emulsion paving are slurry seal pavers. The large size and configuration of these paving machines are suited for asphalt surfacing over the cross section of a road.

However, in addition to the fact that aggregate materials have not been used in asphalt compositions for crack filling operations, the hot asphalt mix plants and slurry seal pavers used in the art for road paving operations are entirely unsuited for crack filling operations. In one respect, the design, size, capacity, and bulky construction of these machines are much too large and ill configured for crack filling operations. Hot mix asphalt plants are centrally located so that the hot mix product must be carried from the plant via dump trucks. Slurry seal pavers are large truck-mounted plants.

Also, slurry seal pavers, for example, are specialized, high capacity paving systems which are designed and configured solely to provide proper component sequencing for the formation of highly aqueous compositions suitable for road paving. These compositions are not suited for crack filling operations because, in contrast to an exposed layer of pavement, deep cracks have very limited atmospheric exposure, which would substantially prevent an aqueous system from breaking, setting, and curing adequately. And, if these compositions were not adequately hydrated for properly wetting the side walls and aggregate, the system would fail.

Moreover, even if a slurry seal paver were capable of forming a workable crack repair composition, the system and machinery which would be required to (a) quickly reroute a relatively small stream of material from the large paver from one distressed pavement location to the next and then (b) precisely deliver the material into a crack would, if capable of construction, be costly and complex.

A need, therefore, exists for an improved road surface composition, process, and apparatus which will: allow rapid repairs with a quick setting time; minimize road downtime; provide significantly greater load bearing capability, skid resistance, and service life; reduce costs and energy requirements; and reduce emissions. As recognized by the present inventors, what is needed is a cold pour composition, process, and applicator apparatus for sealing road cracks, potholes, or other distressed road areas in need of repair.

In addition, a need exists for an improved aggregate filler material, and improved asphalt mixtures containing such aggregate materials, which will provide significantly improved load-bearing capability, service life, and lateral load distribution properties.

SUMMARY OF THE INVENTION

The present invention provides a road repair composition, a road repair process, and a road repair apparatus which satisfy the needs and alleviate the problems discussed above.

In one aspect, there is provided a composition for road repair uses comprising a cationic cold pour asphalt emulsion and a graded aggregate material. The graded aggregate material is characterized in that: from 7% to 21% by weight of the graded aggregate material passes a number 100 sieve; from 12% to 30% by weight of the graded aggregate material passes a number 50 sieve; from 19% to 50% by weight of the graded aggregate material passes a number 30 sieve; from 45% to 95% by weight of the graded aggregate material passes a number 8 sieve; and from 70% to 100% by weight of the graded aggregate material passes a number 4 sieve.

In another aspect, there is provided a method of repairing a damaged area (e.g., a crack or pothole) in a road surface comprising the steps of: (a) forming a composition of the type described above by mixing together the cationic cold pour asphalt emulsion and the graded aggregate material and (b) delivering the composition into the damaged area. The composition formed in step (a) will preferably be such that the graded aggregate material is present in the composition in an amount of at least 30% by weight of the total weight of the composition.

In yet another aspect, there is provided a method of repairing a damaged area (e.g., a crack or pothole) in a road surface comprising the steps of: (a) mixing together a cold pour asphalt emulsion and an aggregate material to form a composition such that the aggregate material is present in the composition in an amount of at least 30% by weight of the total weight of the composition and (b) delivering the composition into the damaged area.

In yet another aspect, each embodiment of the invention described above can be further modified, supplemented, or characterized by one or more of the following:

- The aggregate material being a graded aggregate material;
- The aggregate material being further characterized in that from 4% to 15% by weight of the aggregate material passes a No. 200 sieve;
- The asphalt emulsion being a cationic cold pour asphalt emulsion which is latex modified;
- The composition further comprising a recycled tire material;
- The composition comprising a cationic cold pour asphalt emulsion and an aggregate material such that when the cationic cold pour asphalt emulsion and the aggregate material are mixed together in the composition, the cold pour asphalt emulsion will break and the composition will set in a total time of not more than 20 minutes;
- The composition comprising a cold pour asphalt emulsion and an aggregate material which are mixed together and then delivered into the damaged area in a total time of not more than 20 seconds;
- The cold pour asphalt emulsion and the aggregate material being mixed together for not more than 10 seconds and the composition being delivered into the damaged area in not more than 10 seconds after mixing;
- The cold pour asphalt emulsion and the aggregate material being continuously delivered to and mixed in a mixer;
- A procedure of this type wherein the mixer is suspended above the damaged area of the road surface when the composition is delivered into the damaged area; and/or
- A procedure of this type wherein the mixer is suspended behind a vehicle and the cold pour asphalt emulsion and the aggregate material are continuously delivered to the mixer from containers which are carried by the vehicle.

In another aspect, there is provided an apparatus for repairing damaged areas in road surfaces comprising: (a) an aggregate container mountable on a vehicle for holding an aggregate material; (b) an emulsion container mountable on a vehicle for holding a quickset cold pour asphalt emulsion; (c) a mixing assembly for receiving and mixing the aggregate material and the quickset cold pour asphalt emulsion to form a repair composition; (d) a conveying assembly for delivering the aggregate material from the aggregate container to the mixing assembly, wherein the conveying assembly has a receiving end positioned for receiving the aggregate material from the aggregate container and the receiving end is pivotably mountable for pivoting the conveying assembly from side-to-side; and (e) a conduit for delivering the quickset cold pour asphalt emulsion from the emulsion container to the mixing assembly. The mixing assembly is secured at a discharge end of the conveying assembly such that the conveying assembly will hold the mixing assembly in suspension over the road surface for delivering the repair composition into the damaged area.

In yet another aspect, the inventive apparatus can optionally be configured and/or characterized in accordance with one or more of the following such that:

- The apparatus is operable for continuously delivering the aggregate material and the quickset cold pour asphalt emulsion to the mixing assembly;
- The mixing assembly is operable for mixing the aggregate material and the quickset cold pour asphalt emulsion together to form the repair composition in not more than 10 seconds;
- The mixing assembly, when suspended over the distressed area, is operable for delivering the repair composition into the distressed area in not more than 10 seconds after the aggregate material and the quickset cold pour asphalt emulsion are mixed;
- The mixing assembly comprises a mixing chamber having at least one pair of rotatable mixing elements therein;
- A bottom discharge opening is provided in the mixing chamber and the apparatus further comprises a conically-shaped fitting on the discharge opening for delivering the repair composition downwardly into the damaged area; and/or
- The mixing assembly further comprises (a) an upper bin for receiving the aggregate material from the conveying assembly and (b) a flexible auger extending between a bottom opening of the bin and an upper opening of the mixing chamber.

Further aspects, features, and advantages of the present invention will be apparent to those of ordinary skill in the art upon examining the accompanying drawings and upon reading the following detailed description of the preferred embodiments.

DETAILED DESCRIPTION OF THE PREFERRED EMBODIMENTS

Figure 1:
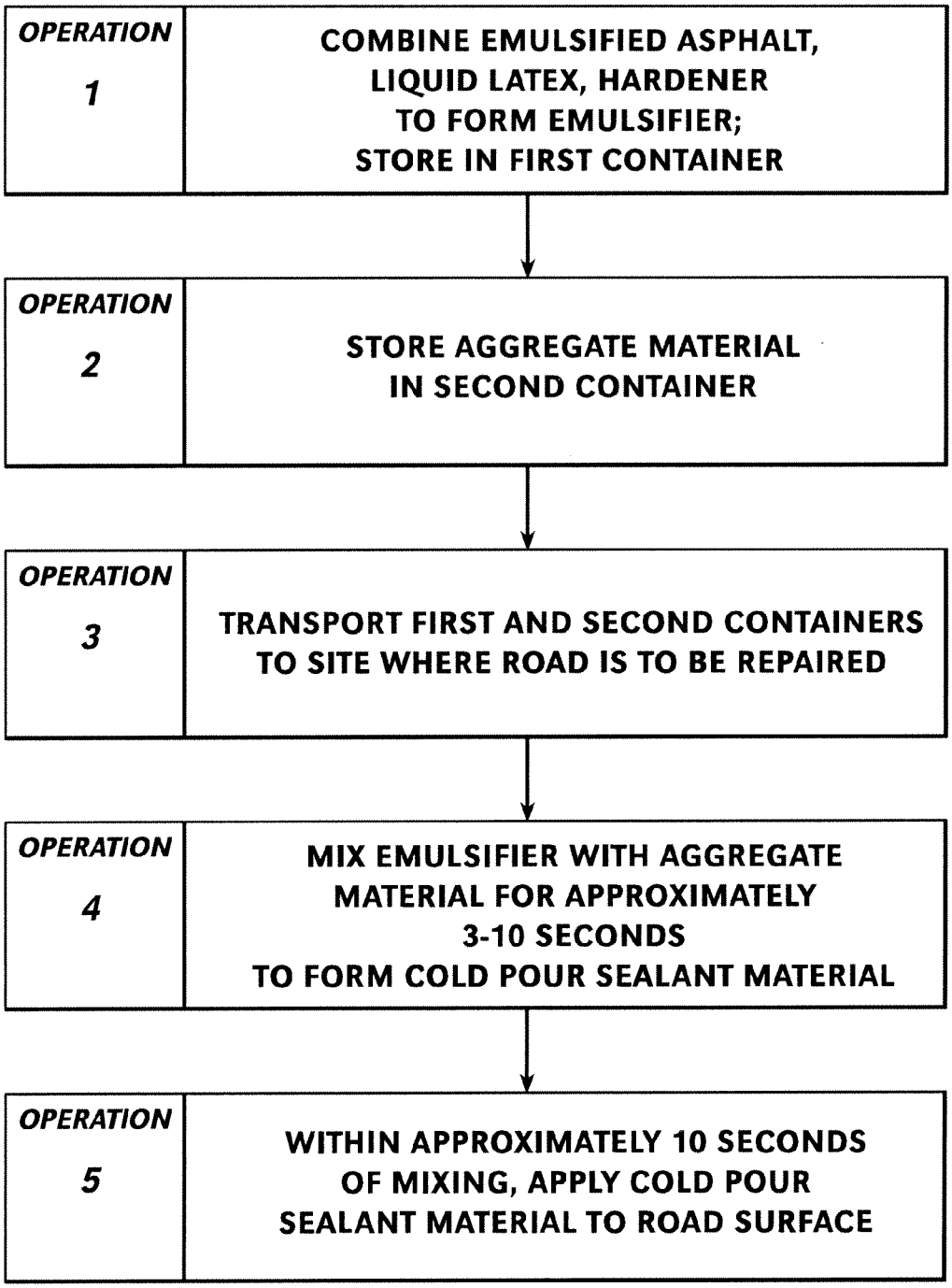
FIG. 1 illustrates an example of a process for forming a cold pour sealant composition, in accordance with one embodiment of the present invention.

Disclosed herein are compositions, processes, and devices for sealing and repairing road surfaces using a novel cold pour sealant composition. As described below, through the use of embodiments of the present invention, a cold pour repair sealant composition/material is formed and once applied to a road surface (e.g., a distressed pavement area such as within a crack or pothole), the sealant material sets and cures quickly, thereby permitting the road to be repaired quickly, typically within 10-20 minutes after applying the sealant material.

When the inventive composition is applied in a crack or pothole in accordance with the inventive process, the inventive sealant wets the surfaces of the crack or pothole, thereby significantly improving bonding to the sidewall. Next, the emulsion phase of the sealant breaks inside the crack or pothole so that the continuous water phase of the emulsion is released and the asphalt begins to coalesce. Then, a setting stage begins wherein cohesion with the sidewalls and the aggregate components of the mixture takes place. At this point, the green strength of the inventive composition at the end of the setting stage will typically be sufficient to permit the resumption of traffic flow. Finally, the composition cures in the crack or distressed area so that the final strength, stiffness, and flexibility of the material is achieved to provide long term performance.

In this way, the repaired portion of the road can be ready to receive traffic much sooner than when compared to conventional hot pour road repair techniques. Additionally, through the use of embodiments of the present invention, preparation of the cold pour repair sealant material can be achieved without the consumption of extensive amounts of energy when compared with conventional hot pour road repair techniques. Various embodiments of the invention are disclosed herein.

Cold Pour Repair Sealant Composition/Material

In one example of the present invention, a composition is formed which can be used as a cold pour repair sealant material. The repair sealant composition may preferably comprise, in one example, four components: emulsified asphalt; liquid latex; a hardener; and mineral aggregate material (e.g., crushed stone and mineral filler). The emulsified asphalt, liquid latex, and hardener form an emulsion blend. If desired, a fifth material—one or more recycled materials (e.g., tire rubber such as ground up recycled tires or crumb rubber, reclaimed asphalt, and/or reclaimed shingles)—may be added to the composition.

In one example, the emulsified asphalt portion of the repair sealant composition may preferably comprise cationic quick set (CQS) emulsified asphalt, which can be latex modified with approximately 1-25%, more preferably approximately 3-5%, polymer. The emulsified asphalt portion of the composition can, in one example, preferably comprise approximately 10-50%, more preferably approximately 30-50%, by weight of the total weight of the repair sealant composition. In one example of the invention, the emulsified asphalt portion will most preferably be a CQS asphalt emulsion selected or created, as will be readily understood by those in the art, to meet the following specifications: American Association of State Highway and Transportation Officials AASHTO) m 208, with or without the following modifications:

Physical Properties: C.A.S, Number: 8052-42-4, Boiling Point (F): 212° F., Specific Gravity (H20=1): 1.01; Percent Volatile: 0; Solubility In Water: Soluble; Flammability: Nonflammable in water-based state Typical Physical Properties (Property, Test Procedure, Min, Max): Viscosity, Saybolt Furol, 77° F., sec T72 20 100; Sieve test, % T59-0.1; Cement mixing, % T59-2.0; Storage stability, 1 day, % T59-1; Particle charge T59 Positive; Distillation test, T59; Residue by distillation, % by wt., 62; Oil distillate, % by volume of emulsion, 0.5; Tests on residue from distillation: Penetration, 77° F., 100 g, 5 sec. T49 40 90; Solubility in trichloroethylene, % T44 97; Ductility, 77° F., 5 cm/min., cm T51 70; Softening Point 125; Specific Gravity (H20=1): 1.01

Test Quality: AASHTO T 59 Residue after distillation 62% minimum; b. Modify the standard distillation procedure as follows: Slowly bring the temperature on the lower thermometer to 350° F.+/−10° F. (177° C.+/−5° C.) and maintain at this level for 20 minutes. The total distillation shall be completed in 60 minutes+/−5 minutes from the first application of heat. SS-09003. Test On Residue, AASHTO T 53 Ring and Ball Softening Point 135° F. (57° C.) minimum.

Suitable CQS asphalt emulsions are commercially available from numerous manufacturers and suppliers such as, e.g., Ralumac (MWV emulsion) Ergon, Colas, Asphalt Materials, and others. Examples of emulsifiers suitable for producing acceptable CQS emulsions include, but are not limited to: amidoamine emulsifiers; imidazolines; non-ionic emulsifiers; quaternary ammonium emulsifiers; triamines; tetra-amines; penta-amines; and others.

An example of one CQS cold pour emulsion preferred for use in the present invention comprises: about 65% by weight asphalt; from about 1 to about 1.5% by weight amidoamine emulsifier; about 2% by weight latex; and sufficient HCl to bring the emulsifier, latex, and water soap solution to a pH of from about 2 to about 2.5.

The liquid latex portion of the composition may preferably comprise, in one example, a liquid latex-based polymer modifier (such as BASF NS 175, NX 1129, NS 198, or NX 1138 (the BASF Butonal product line); Ultrapave anionic latex products UP-70, UP-7289, or UP-2897; or Ultrapave cationic latex products UP-65K, UP-1152, or UP-1158). The liquid latex portion of the composition can, in one example, preferably comprise approximately 0.5% to 10%, more preferably approximately 0.5% to 4%, by weight of the total weight of the repair sealant composition.

In the inventive composition, the liquid latex additive adheres to both the aggregate material and to the sidewalls of the crack. The adhesive properties and elasticity of the liquid latex increase the strength, performance and durability of the inventive repair sealant composition. Examples of other suitable liquid latex additives include, but are not limited to: various block polymers such as SBS, EVA (ethylene-vinyl acetate), DuPont Evaloy, acrylics, and silicones.

The hardener portion of the composition may preferably comprise, in one example, 47sq with peredyne3 or equivalent. Examples of other suitable hardener additives include, but are not limited to: cement, other mineral fillers, acrylics, and EVA. The hardener portion of the composition can preferably, in one example, comprise approximately 0.05% to 5%, more preferably 0.05% to 1.5% by weight of the total weight of the composition. In one example, if the softening point of the composition is greater than 135 degrees, the hardener portion of the composition may be omitted.

The mineral aggregate used in the inventive composition can generally be any type of aggregate used in asphalt paving materials. The mineral aggregate material portion of the composition may preferably comprise, in one example, a combination of crushed stone and mineral filler material. The mineral aggregate portion of the composition can preferably, in one example, comprise approximately 30 to 55% by weight of the total weight of the composition.

In one example of the invention, the mineral aggregate material used in the inventive composition will most preferably be a graded aggregate material and will preferably be selected or created to meet the following specifications:

Crushed stone (e.g., limestone, granite, gravel, and/or basalt) from sources that will produce aggregate complying with the following:

An abrasion loss of no more than 30% and a freezing-and-thaw loss of no more than 10 (Iowa Materials Laboratory Test Method 211, Method A) when tested using aggregate crushed to ¾ inch (19 mm) maximum size.

Free of deleterious materials.

Type 2 or Type 3 friction classification according to Materials I.M. T-203 or AASHTO equivalent Sand equivalent of not less than 60, as determined according to AASHTO T 176.

Gradation of Aggregate:

| Type I [Sieve (Mesh) Size, Percent Passing] | Type II [Sieve (Mesh) Size, Percent Passing] |
|---|---|
| ⅜" (9.5 mm) 100 | ⅜" (9.5 mm) 100 |
| #4 (4.75 mm) 90-100 | #4 (4.75 mm) 70-90 |
| #8 (2.36 mm) 65-90 | #8 (2.36 mm) 45-65 |
| #16 (1.18 mm) 45-70 | #16 (1.18 mm) 45-70 |
| #30 (600 urn) 30-50 | #30 (600 urn) 19-34 |
| #50 (300 urn) 18-30 | #50 (300 urn) 12-25 |
| #100 (150 urn) 10-21 | #100 (150 urn) 7-18 |
| #200 (75 urn) 5-15 | #200 (75 urn) 4-12 |

Mineral Filler—if used: free of lumps and meeting the requirements for Type I Portland Cement. Besides Portland Cement, the mineral filler might also comprise or consist of fly ash and/or lime.

The Type I aggregate gradation profile provided above is preferred for repairing cracks and other smaller openings. The Type II profile is preferred for repairing more distressed features such as small to medium potholes.

The above-described graded aggregate materials operate in the inventive road repair composition to: (a) provide a stronger structural framework, (b) improve load-bearing strength, (c) improve the transfer of downward loads laterally into the sidewalls of the crack or pothole, (d) provide an appropriate volumetric design for crack filling, (e) allow the mastic to be formed without over-asphalting so that "bleeding pavement conditions" are prevented, and (f) improve the skid resistance of the compositions versus traditional cold pour or hot pour crack filling compositions.

Optionally, tire rubber such as ground up recycled tires or crumb rubber may be added to the composition. Although not required, in one example, the tire rubber is preferably ground up not to exceed #16 sieve size. The tire rubber portion of the composition can, in one example, comprise approximately 0 to 27% by weight of the total weight of the composition.

Additives may be added to the emulsion mix or any of the component materials to provide control of the quick-set properties and increase adhesion. Such additives should be certified as to their compatibility with other components of the mix. Examples of such additives include, but are not limited to: Portland cement; other anionic additives; high surface materials; or products which will produce exothermic reactions in the presence of the mixture.

The inventive repair sealant composition can also comprise cellulose fiber, carbon black, and/or dark fiber. A dark fiber material such as fine recycled asphalt shingles (RAS) is preferred over the use of carbon black and cellulose. The fine RAS will preferably have a particle size passing a number 16 sieve (mesh) and will more preferably have a particle size wherein a majority will pass a number 50 sieve. The RAS will also preferably comprise a substantial amount of fiberglass, as well as oxidized asphalt which improves stiffness, asphalt thickness with the mixture, and tensile strength characteristics. These materials also produce further improvements in load bearing characteristics without causing brittleness. Additionally, the RAS additive will improve the water-proofing characteristics of the mixture and provides a stable black color.

If used in the inventive repair composition, the fine RAS will preferably be present in an amount in the range of from about 5% to about 75% by weight (more preferably from about 15% to about 40% by weight) of the total weight of the composition. The RAS will preferably be combined with the emulsion blend along with the aggregate filler at the time of use and can optionally be premixed with the aggregate and/or mineral filler.

Another ingredient which can optionally be used in the inventive repair sealant composition is additional water (i.e., water beyond that contained in the CQS emulsion or incidentally contained in other additives). Although generally not needed, selective water addition may operate in some cases to further enhance the wetting and coating of the emulsion on the crack sidewalls, the fine aggregate, and/or a dark fiber. This can allow a more economical use of the asphalt binder constituent for binding and weatherproofing, versus lubricity of the mastic or mixture.

The inventive composition is preferably formed without supplemental water addition or with only limited supplemental water addition preferably not exceeding 10% by weight, and more preferably an amount in the range of from about 3% to about 8% by weight of total weight of the inventive repair sealant composition. The blending of the various materials of the inventive composition to a comparatively uniform mixture surface area reduces the need for excess water, which speeds the setting and curing processes without compromising sidewall wetting.

Also, another additive which can be used in the inventive repair sealant composition is silicone. Silicone can be included at the time of mixing the emulsion blend and aggregate in order to assist in triggering the breaking of the emulsion. Additional benefits of silicone addition can include: early mix cohesion, improved adhesion to pavement, improved water repellency, improved temperature range performance through freeze/thaw cycles and summer temperatures, increased strength, improved flexibility, and more rapid curing.

If used, the amount of silicone added will preferably be in the range of from about 2% to about 35% by weight, and will more preferably be from about 3% to about 10% by weight, of the total weight of the sealant composition.

Process for Forming and Using the Cold Pour Sealant Composition/Material

In one example of the invention and referring to FIG. 1, a process for forming a cold pour sealant material of the present invention is shown. Operation 1 forms an emulsion blend (e.g., the combination of CQS emulsified asphalt, the liquid latex, and the hardener). The emulsion blend can be stored for instance in one or more chemical tanks. At operation 2, the aggregate material is stored apart from the emulsion blend, for example in a metal hopper. Operation 2 can precede operation 1 if desired.

Both the emulsion blend and the aggregate material, being separately stored, are transported to the site where the road crack repair is to take place (operation 3). Then, because of the quick setting properties of the inventive composition and the speed at which the cationic asphalt emulsion breaks when brought into contact with the aggregate material, the mixing of the aggregate with the emulsion blend (operation 3) and the application of the mixture to the crack or pothole (operation 4) will preferably be completed in a total time of not more than 30 seconds and will more preferably be completed in about 5 seconds. The total time available for site mixing and application will vary depending upon the particular CQS emulsion, aggregate, and other additives used.

In operation 3, the emulsion blend and the aggregate material are preferably mixed together for approximately 3 to 10 seconds, along with any other chemical additives and/or crum rubber if used, to form the cold pour sealant material (operation 4). Examples of further chemical agents which might be added to the inventive composition include, but are not limited to: cement; lime; salts; surfactants; tall oil derivatives; pitch; gilsonite; acrylics; latex; and polymers.

Then, in operation 5, the cold pour sealant material is most preferably applied to the road surface within and about the portion of the road being repaired (i.e., within the crack(s) or pothole(s)) within (i.e., in preferably not more than) 10 seconds of being mixed. The cold pour sealant material may dry within approximately 10 minutes, and traffic can be routed onto the repaired portion of the road within approximately 5-30 minutes, more preferably approximately 15-20 minutes, after applying the cold pour sealant material to the road.

If desired, before the cold pour sealant material is applied to the road, the road crack/pothole/area is cleaned and prepared by conventional techniques, such as through the use of compressed air to remove debris from the crack/pothole/area.

Figure 2:
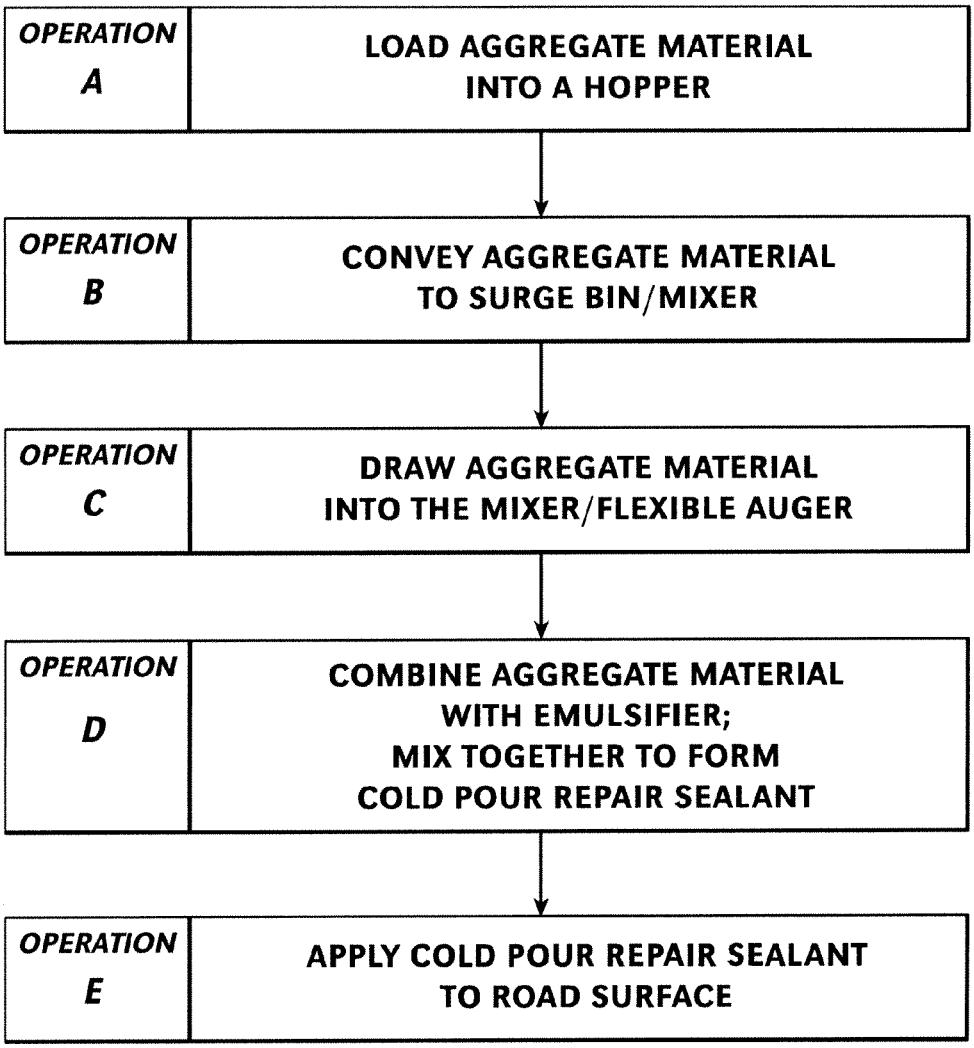
FIG. 2 illustrates another example of a process for forming a cold pour repair sealant material and repairing a road using the cold pour repair sealant material, in accordance with one embodiment of the present invention.
Figure 6:
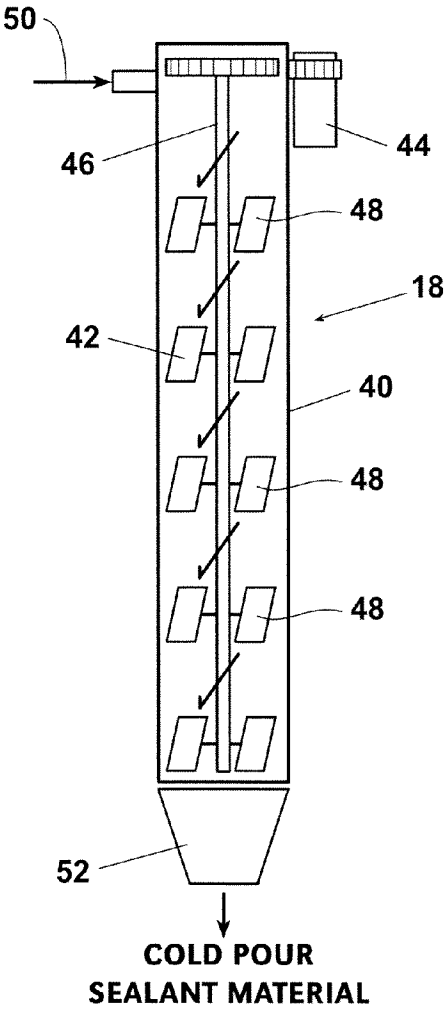
FIG. 6 is a cutaway elevational side view of an embodiment of a small pugmill-type mixer 16 provided by and used in the present invention.

FIG. 2 illustrates another example of a process for foaming a cold pour repair sealant material and repairing a road using the cold pour repair sealant material, in accordance with one embodiment of the present invention. This process may be used in conjunction with the applicator apparatuses described below and shown in FIGS. 3-7. At operation A, aggregate material is loaded into a hopper 10. At operation B, the aggregate material is conveyed onto a conveyor 38, and the aggregate material is conveyed from the conveyor 38 into a second hopper 14 such as a bin. At operation C, a flexible auger 16 draws the aggregate material into a mixer 18 which may be contained within the flexible auger 16. At operation D, the mixer 18 combines the aggregate material with the emulsion blend.

The mixer 18 mixes the emulsion with the aggregate material (and any other chemical additives, and/or tire rubber), thereby forming the cold pour repair sealant material. In a most preferred example, as noted above, the mixing operation occurs for a duration of approximately 3 to 10 seconds for a given amount of emulsifier and aggregate material. At operation E, the cold pour repair sealant material is applied on the road most preferably within approximately 10 seconds of being mixed/formed.

Applicator Apparatuses

FIGS. 3-6 illustrate examples of devices and apparatuses for transporting, mixing, forming and applying cold pour repair sealant material to road surfaces, in accordance with one embodiment of the present invention.

As shown in FIGS. 3-6, the device may include one or more hoppers/bins 10 for holding the aggregate material; and one or more chemical tanks 20 and 22 for storing the emulsion blend and any other chemicals, wherein the chemical tank 20 stores the emulsion blend separate and apart from the aggregate material. The chemical tanks 20 and 22 are provided with fluid output tubes/lines/conduits 24 and 26 so that the emulsion/chemicals can be delivered, as driven by one or more motors (preferably low shear pumps 28 and 30), to a mixer section 18 of a flexible auger 16 (or telescopic conveyor in another embodiment), described below. The pumps 28 and 30 are preferably Viking gear pumps. The fluid lines 24 and 26 may include in-line fluid flow meters 32 and 34 or other conventional valves or controls, for use in regulating, limiting or controlling the rate at which the emulsion or other chemicals are delivered from the chemical tanks 20 and 22.

Figure 3:
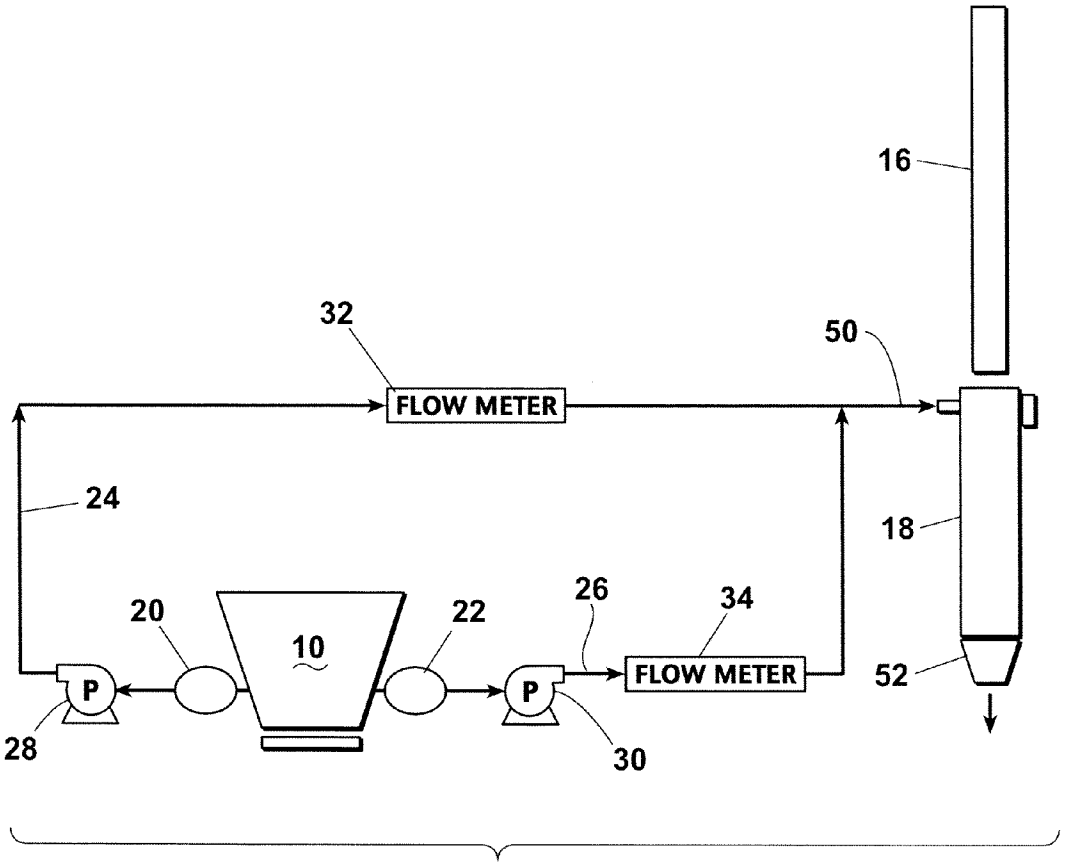
FIG. 3 illustrates the process flow between significant components of one example of an applicator apparatus to form and dispense a cold pour composition to repair road surfaces, in accordance with one embodiment of the present invention.
Figure 4:
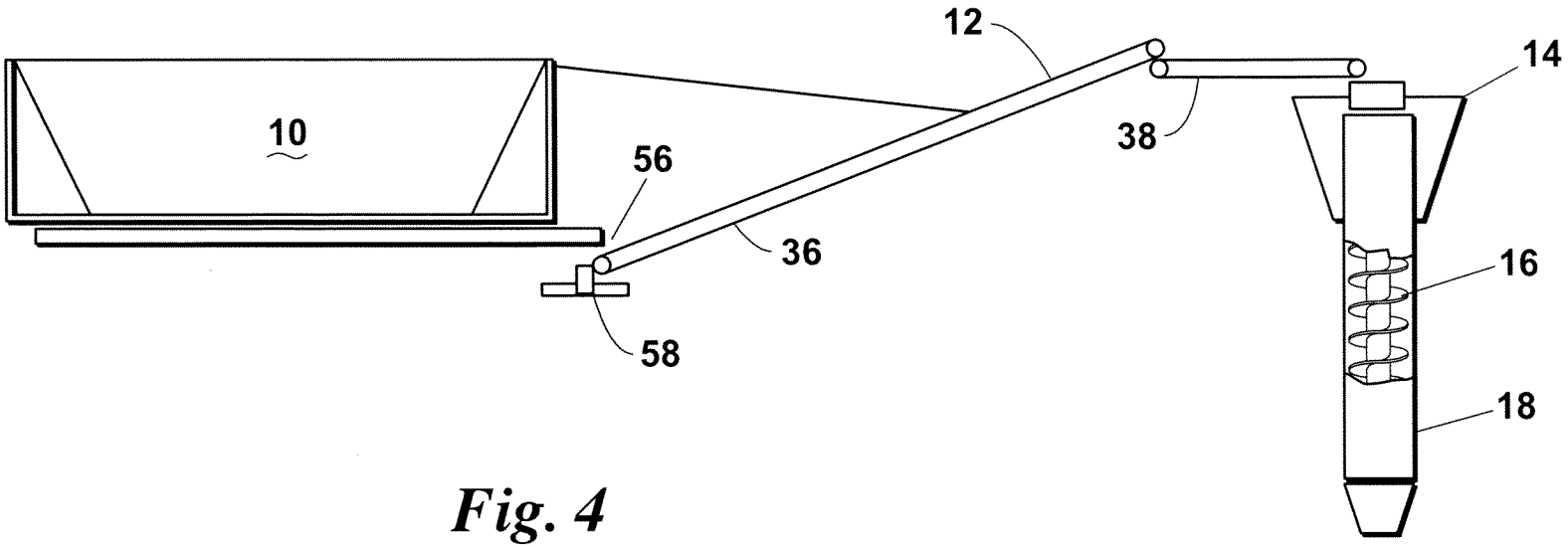
FIG. 4 is an elevational side view of the applicator apparatus of FIG. 3 with emulsion tanks, chemical tanks, and fluid lines not shown.
Figure 5:
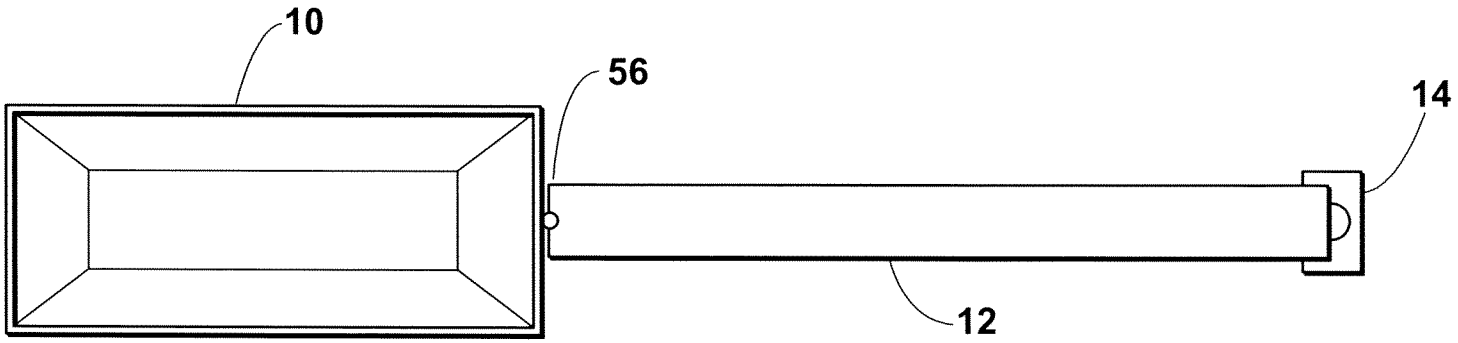
FIG. 5 is a top plan view of the applicator apparatus of FIGS. 3 and 4, also with emulsion tanks, chemical tanks, and fluid lines omitted.

One or more conveyors receive the aggregate material and deliver the aggregate material into a surge bin 14. In FIG. 3, the conveyor(s) comprise a conveyor 36 under the hopper 10 and another conveyor 38 to deliver the aggregate material to the surge bin 14. The conveyers 36 and 38 may be a conventional variable speed conveyor(s) with controls to allow a user to stop, start and control the speed of the conveyors. The surge bin 14 feeds a flexible auger tube 16 (or a telescopic conveyer in an alternative embodiment), which has, within its output end, a mixer section 18. The mixer section 18 receives the aggregate material. The mixer section 18 is also fluidly coupled with the chemical tanks 20 and 22, so that the mixer section 18 receives the emulsion and any other chemicals.

In one example, the mixer section 18 can preferably be about 12 to 16 inches in length, and about 4 to 6 inches in diameter, which can be relatively small when compared with a length of the flexible auger tube. The mixer section 18 can be formed from a hollow tube (mixing chamber) 40, and within the mixer section 18, a pugmill-type mixer 42 can be included with a motor 44 that drives the mixer section. The small pugmill-type mixer 42 may include a shaft 46 and one or more sets of paddles 48 connected to the shaft 46. At the input/top portion of the mixer section 18, aggregate material is received from the flexible tube portion of the auger 16. The input portion of the mixer section 18 also is connected with one or more hose (s)/tube(s) 50 from the one or more chemical tanks 20 and 22.

Hence, as described above, the aggregate material and the emulsion blend are mixed together within the mixer section 18, thereby forming the cold pour repair sealant material.

In one example, the output/bottom portion of the mixer section 18 is preferably coupled with a removable tip 52, which may preferably be conically shaped. Through the mixing action of the auger/pugmill 42 within the mixer section 18, along with gravity, the cold pour repair sealant material is formed and delivered out the output end of the mixer section 18 through the tip 52, and can be applied by a user to a road surface for repairing cracks, potholes or other areas in need of repair.

The components described for the apparatuses can be made portable by incorporation or attachment to a vehicle such as a truck or other motorized vehicle. To facilitate the quick movement of the outlet application tip 52 from one distressed area of the pavement to another when conducting road repairs, the inlet end 56 of aggregate conveyor 36 is preferably pivotably attached beneath the aggregate hopper 10 so that the entire boom structure comprising the conveyors 36 and 38, surge bin 14, the auger 16, and mixer 18 can be laterally pivoted at least 20° both left and right. The pivot connection is preferably made to a thrust bearing 58 installed on a truck bed or an apparatus frame (not shown). In addition, a hand-held remote can be provided and operated, if desired, for pivoting the conveyor and applicator boom structure to the left or to the right and can also be used to signal the vehicle operator to slow down, stop, or speed up. The flexible auger structure also allows the operator to reposition the discharge nozzle to some degree by hand.

The apparatus illustrated in FIGS. 3-6 can be used to place the discharge tip 52 within 30 inches or less, more preferably within 12 inches or less above the pavement surface.

Figure 7:
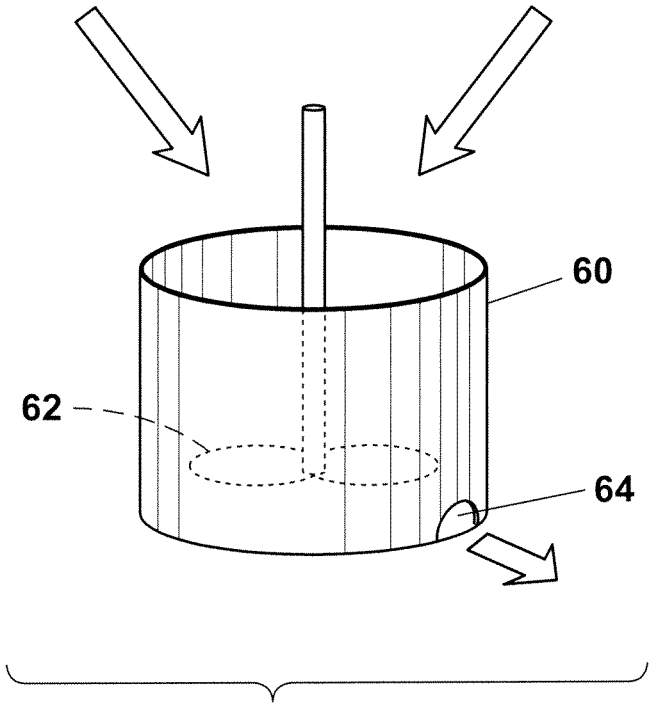
FIG. 7 schematically illustrates an alternative embodiment of the inventive applicator apparatus.

An alternative apparatus which has been successfully tested for rapidly blending the emulsion and aggregate components at the job site and then quickly applying the mixture to pavement cracks is illustrated in FIG. 7. The apparatus is similar to the first embodiment described above except that it comprises a bucket (e.g., a two gallon bucket) or similar container 60 having a paddle mixer or propeller mixer 62 therein. The mixer 62 and mixer motor were held in place in the container 60 by a supporting frame attached to the conveyor boom with a hydraulic motor be used for driving the mixing element 62 in the mixing chamber. A discharge hole 64 was placed in the bottom of the container 62 at the outer edge for applying the inventive mixture to the pavement cracks.

The inventive apparatus of FIG. 7 using a 2 gallon bucket is capable of mixing and applying as much as 1500 to 2500 gallons per day of the inventive repair sealant composition.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

It should be appreciated that reference throughout this specification to "one embodiment" or "an embodiment" or "one example" or "an example" means that a particular feature, structure or characteristic described in connection with the embodiment may be included, if desired, in at least one embodiment of the present invention. Therefore, it should be appreciated that two or more references to "an embodiment" or "one embodiment" or "an alternative embodiment" or "one example" or "an example" in various portions of this specification are not necessarily all referring to the same embodiment. Furthermore, the particular features, structures or characteristics may be combined as desired in one or more embodiments of the invention.

It should be appreciated that in the foregoing description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed inventions require more features than are expressly recited in each claim. Rather, as the following claims reflect, inventive aspects lie in less than all features of a single foregoing disclosed embodiment, and each embodiment described herein may contain more than one inventive feature.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the invention as defined by the claims.

What is claimed is:

1. A method of repairing each of a plurality of damaged areas in a road surface comprising the steps of:

(a) moving a mixing and application apparatus to one of said damaged areas;

(b) delivering a flow of an aggregate material into a mixing chamber of said mixing and application apparatus, said mixing and application apparatus also comprising a mixing element positioned within said mixing chamber and a discharge opening in said mixing chamber;

(c) simultaneously with step (b), delivering a stream of a cold pour asphalt emulsion into said mixing chamber of said mixing and application apparatus;

(d) simultaneously as said cold pour asphalt emulsion and said aggregate material are delivered into said mixing chamber of said mixing and application apparatus in steps (b) and (c), mixing together in said mixing chamber said cold pour asphalt emulsion and said aggregate material to form in said mixing chamber a composition such that said aggregate material is present in said composition in an amount of at least 30% by weight of a total weight of said composition;

(e) simultaneously with steps (b), (c), and (d), delivering a flow of said composition out of said discharge opening in said mixing chamber directly into said one of said damaged areas; and (f) moving said mixing and application apparatus to each subsequent one of said damaged areas and repeating steps (b), (c), (d), and (e) for each said subsequent one of said damaged areas.

2. The method of claim 1 wherein:

from 5% to 15% by weight of said aggregate material passes a number 200 sieve;

from 10% to 21% by weight of said aggregate material passes a number 100 sieve;

from 18% to 30% by weight of said aggregate material passes a number 50 sieve;

from 30% to 50% by weight of said aggregate material passes a number 30 sieve;

from 45% to 70% by weight of said aggregate material passes a number 16 sieve;

from 65% to 90% by weight of said aggregate material passes a number 8 sieve; and from 90% to 100% of said aggregate material passes a number 4 sieve.

3. The method of claim 1 wherein at least one of said damaged areas is a crack in said road surface.

4. The method of claim 1 wherein:

from 4% to 12% by weight of said aggregate material passes a number 200 sieve;

from 7% to 18% by weight of said aggregate material passes a number 100 sieve;

from 12% to 25% by weight of said aggregate material passes a number 50 sieve;

from 19% to 34% by weight of said aggregate material passes a number 30 sieve;

from 45% to 70% by weight of said aggregate material passes a number 16 sieve; and from 70% to 90% by weight of said aggregate material passes a number 8 sieve.

5. The method of claim 1 wherein at least one of said damaged areas is a pothole in said road surface.

6. The method of claim 1 wherein, when said cold pour asphalt emulsion and said aggregate material are mixed together in step (d), said cold pour emulsion breaks and said composition sets in a total time of not more than 20 minutes.

7. The method of claim 1 wherein said cold pour asphalt emulsion is a cationic cold pour asphalt emulsion.

8. The method of claim 7 wherein said cationic cold pour asphalt emulsion is latex modified.

9. The method of claim 1 wherein said cold pour asphalt emulsion and said aggregate material are mixed together in step (d) and said composition is delivered into each said damaged area in step (e) in a total time of not more than 20 seconds.

10. The method of claim 1 wherein said mixing and application apparatus is suspended above each said damaged area of said road surface when said flow of said composition is delivered into each said damaged area in step (e).

11. The method of claim 10 wherein said mixing and application apparatus is suspended behind a vehicle and said stream of said cold pour asphalt emulsion and said flow of said aggregate material are continuously delivered to said mixing chamber of said mixing and application apparatus from containers which are carried by said vehicle.

12. The method of claim 1 wherein said mixing chamber is a hollow tube having said mixing element positioned therein, and wherein said discharge opening is positioned at a lower output end of said hollow tube.

13. The method of claim 12 wherein said mixing and application apparatus further comprises a conically shaped fitting on said discharge opening for directing said flow of said composition out of said discharge opening in step (e) downwardly into each said damaged area.

14. The method of claim 1 wherein said mixing chamber is a mixing bucket having said mixing element positioned therein, and wherein said discharge opening is positioned in a lower portion of said mixing bucket.

15. The method of claim 1 wherein said discharge opening of said mixing and application apparatus is positioned less than 30 inches above each said damaged area during steps (b) through (e).

16. The method of claim 1 wherein said discharge opening of said mixing and application apparatus is positioned less than 12 inches above each said damaged area during steps (b) through (e).

17. The method of claim 11 wherein said mixing and application apparatus is suspended from a discharge end of a pivotable conveyor assembly which delivers said flow of said aggregate material from an aggregate material container carried by said vehicle to said mixing and application apparatus.

* * * * *